US008944944B2

(12) United States Patent
Pedersen et al.

(10) Patent No.: US 8,944,944 B2
(45) Date of Patent: Feb. 3, 2015

(54) METAL OR REINFORCED LIGHTED NOCKS

(71) Applicant: Out RAGE, LLC, Proctor, MN (US)

(72) Inventors: William Edward Pedersen, Duluth, MN (US); Richard Scott Krause, Grafton, WI (US); Jon Arthur Syverson, Cloquet, MN (US)

(73) Assignee: Out RAGE, LLC, Cartersville, GA (US)

( * ) Notice: Subject to any disclaimer, the term of this patent is extended or adjusted under 35 U.S.C. 154(b) by 49 days.

(21) Appl. No.: 13/804,203

(22) Filed: Mar. 14, 2013

(65) Prior Publication Data

US 2014/0187362 A1 Jul. 3, 2014

Related U.S. Application Data

(60) Provisional application No. 61/748,526, filed on Jan. 3, 2013.

(51) Int. Cl.

| | |
|---|---|
| ***F42B 6/06*** | (2006.01) |
| ***F42B 12/36*** | (2006.01) |
| ***F42B 12/42*** | (2006.01) |
| ***F42B 12/38*** | (2006.01) |

(52) U.S. Cl.

CPC ..... *F42B 6/06* (2013.01); *F42B 12/362* (2013.01); *F42B 12/42* (2013.01); *F42B 12/382* (2013.01)

USPC ..... 473/578; 473/570; 473/586

(58) Field of Classification Search

USPC ..... 473/570, 578, 585, 586

See application file for complete search history.

(56) References Cited

U.S. PATENT DOCUMENTS

| | | | | |
|---|---|---|---|---|
| 4,547,837 | A | 10/1985 | Bennett | |
| 6,123,631 | A * | 9/2000 | Ginder | 473/570 |
| 7,021,784 | B2 | 4/2006 | DiCarlo | |
| 7,837,580 | B2 * | 11/2010 | Huang et al. | 473/570 |
| 7,993,224 | B2 | 8/2011 | Brywig | |
| D664,625 | S | 7/2012 | Minica | |
| D669,955 | S | 10/2012 | Minica | |
| D669,956 | S | 10/2012 | Minica | |
| 8,342,990 | B1 * | 1/2013 | Price | 473/586 |
| 8,540,594 | B2 * | 9/2013 | Chu | 473/586 |
| 2009/0097239 | A1 | 4/2009 | Lynch | |
| 2012/0100942 | A1 | 4/2012 | Minica | |
| 2013/0267359 | A1 | 10/2013 | Pedersen | |

FOREIGN PATENT DOCUMENTS

FR 2777647 A1 10/1999

OTHER PUBLICATIONS

Archery Talk—Archers Helping Archers Forum: "Homemade Stuff?", http://www.archerytalk.com/vb/showthread.php?t=201870& page=48&p=5786267 (2007).

Archery Talk—Archers Helping Archers Forum: "Homemade Stuff?", http://www.archerytalk.com/vb/showthread.php?t=201870& page=48&p=5791405 (2007).

(Continued)

*Primary Examiner* — John Ricci

(74) *Attorney, Agent, or Firm* — Covington & Burling LLP

(57) ABSTRACT

The crossbow bolt or arrow nock in certain embodiments of the current invention includes a structural support piece that substantially surrounds and structurally supports the distal end of the nock, which may be made of a clear polymeric material to allow the transmission of light.

9 Claims, 11 Drawing Sheets

(56) References Cited

OTHER PUBLICATIONS

Archery Talk—Archers Helping Archers Forum: "Homemade Stuff?", http://www.archerytalk.com/vb/showthread.php?t=201870& page=62&p=1056170361 (2009).

PCT International Search Report (PCT Article 18 and Rules 43 and 44) for PCT/US2013/076108, Mar. 13, 2014.

PCT Written Opinion of the International Searching Authority (PCT Rule 43*bis*. 1) for PCT/US2013/076108, Mar. 13, 2014.

* cited by examiner

METAL OR REINFORCED LIGHTED NOCKS

CROSS-REFERENCE TO RELATED APPLICATIONS

This application claims the benefit under 35 U.S.C. §119 (e) of U.S. Provisional Patent Application No. 61/748,526, filed Jan. 3, 2013, herein incorporated by reference in its entirety.

FIELD OF EMBODIMENTS OF THE INVENTION

Embodiments of the present invention generally relate to a reinforced lighted nock adapted for use with arrows or crossbow bolts that is structurally more robust in comparison to previously known lighted nocks.

BACKGROUND OF EMBODIMENTS OF THE INVENTION

A nock fits into or attaches to the trailing end of an arrow or a crossbow bolt and acts as the means to transfer launching energy between the projectile and the launching device. Lighted nocks, which include a power source as well as a light source powered by the power source, have become increasingly desirable, because they allow tracking the arrow or bolt in flight, as well as locating the arrow or bolt after the shot is taken.

FIG. 1 depicts a crossbow "capture" style nock 10 being received into bore 95 of crossbow bolt 90, as disclosed in application Ser. No. 61/621,211, filed Apr. 6, 2012, and application Ser. No. 13/785,862, filed Mar. 5, 2013, each of which are incorporated herein by reference in their entirety. Nock 10 includes three sections: a proximal end 80, an intermediate portion 60 contiguous with proximal end 80, and distal end 20 that is contiguous with intermediate portion 60. In this embodiment, proximal end 80 is of cylindrical shape and has a diameter that is smaller than the diameters of each of the cylinder-like intermediate portion 60 and distal end 20. Compliant arms 70 project from the surface of intermediate portion 60 and may be arranged in a spiral configuration.

As illustrated in FIG. 1, proximal end 80 and intermediate portion 60 of nock 10 are configured to be received into bore hole 95 of bolt 90. When so received, compression of compliant arms 70 of nock 10 by the inner surface of bore 95 of bolt 90 provides a friction fit that provides one way of attaching nock 10 to bolt 80.

Distal end 20 of nock 10 contains, at its distal end a slot or a groove that provides an opening 40 that is configured to receive the string of a bow or crossbow. Distal end 20 also includes button 50, which may be transparent to allow light produced within nock 10 to be transmitted outside through button 50, and which is configured to turn on the light source of nock 10 when depressed (for example, when depressed due to the tension of the crossbow string during operation). In embodiments in which nock 10 is a lighted nock, nock 10 may also include an internal power source such as a battery to power the internal lighting mechanism. For example, proximal end 80 may be one end of a battery, the other end of which is within intermediate portion 60 (and not depicted in FIG. 1).

Conventional lighted nock systems for both bows and crossbows utilize an optically clear polymeric construction design to transmit light from an LED within the assembly to the outside of the assembly for tracking of the projectile flight, and projectile location after it has stopped flight.

Unfortunately, the choices of polymers that are suitable for this application are fairly limited with clear polycarbonate being the most common. The strength of clear polycarbonate is typically limited to a yield strength near 9,000 psi. This has generally been found to not be sufficient, as clear plastic nocks have a history of breakage in normal operation. The breakage of these nocks has become increasingly severe as bows and crossbows have become more powerful. While most nocks have the potential to break upon the projectile striking a target, it has been observed many times that some crossbows will break clear polymeric bodied nocks during the act of firing the projectile. This is very dangerous to the archer and may potentially cause catastrophic damage to the bow or crossbow.

For these reasons, there is a need for a lighted nock adapted for use with arrows or crossbow bolts that is structurally more robust in comparison to previously known lighted nocks.

SUMMARY OF EMBODIMENTS OF THE INVENTION

The nock in certain embodiments of the current invention includes a structural support piece that substantially surrounds and structurally supports the distal end of the nock, which may be made of a clear polymeric material to allow the transmission of light. In some of these embodiments, the nock contains a light source such that light emitted from the light source is transmitted through the clear polymeric material and at least partially redirected by the structural support piece (which in certain aspects of the certain embodiments may include a reflective metallic material, such as one or more metals (including one or more metal alloys)) in the backwards direction. As a result, the light from the nock is more focused in the backwards directions (for example, the directions contained within a solid angle of $\pi$ steradians centered around the distal end of the nock and the axis formed by the line between the distal end of the nock at an instant during its flight and the point of release of the nock) compared to the nock without the structural support piece.

The structural support piece may be constructed of or include aluminum or other structural support materials such as Mg, Ti, steel, stainless steel, and/or high strength, structural polymeric or composite materials. Structural polymer materials that may be used to construct the structural support piece may include nylon, delrin, carbon reinforced polymers, fiberglass reinforced polymers, PEEK, PMMA, and/or urethane. Additional polymers or composites serving the same purpose of supporting the less structurally robust clear polymeric piece in a lighted nock may be used in embodiments of the invention.

The nock in certain embodiments of the current invention includes a structural support piece that substantially surrounds and structurally supports the distal end of the nock. Both the structural support piece and the distal end of the nock can be made from a clear ceramic material such as aluminum oxynitride (AlON). Both the structural support piece and the distal end of the nock can also be made from nanoparticle aluminum oxide ($Al_2O_3$) or nanoparticle spinel ($MgAl_2O_4$). In certain embodiments, the structural support piece and the distal end can be separate components. In other embodiments, the structural support piece and the distal end can be manufactured as a single, integrated piece. The nock contains a light source such that light emitted from the light source is transmitted through the distal end and at least partially redirected by the structural support piece in the backwards direction. The use of a clear ceramic support embodiment would be beneficial in applications in which it is desired to have a greater amount of light transmitted from the sides of the structural piece when compared with the opaque structural material embodiment.

BRIEF DESCRIPTION OF THE DRAWINGS

FIG. 6D shows the cross sectional view of section 6A-6A of FIG. 6A when the nock light is on.

FIG. 7D shows the cross sectional view of section 7A-7A of FIG. 7A when the nock light is on.

DESCRIPTION OF EMBODIMENTS OF THE INVENTION

Figure 1:
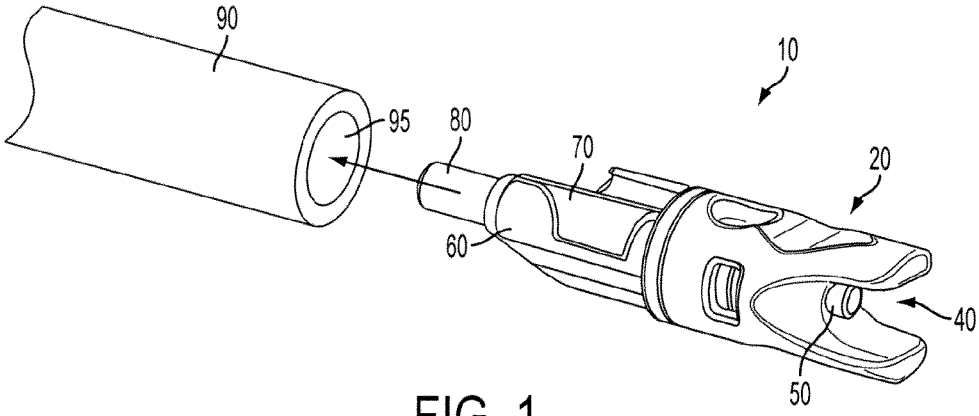
FIG. 1 depicts a conventional crossbow "capture" style nock.
Figure 2A:
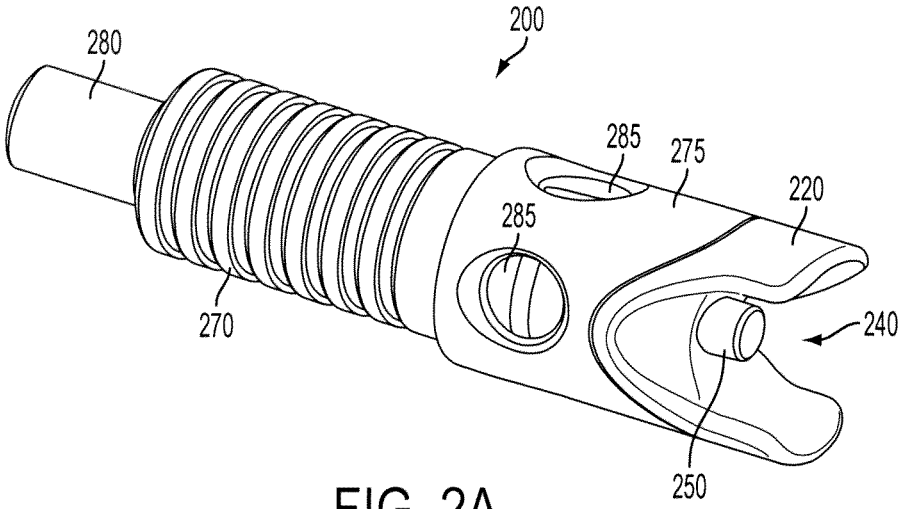
FIG. 2A depicts a crossbow "capture" style nock in accordance with an embodiment of the invention.
Figure 2B:
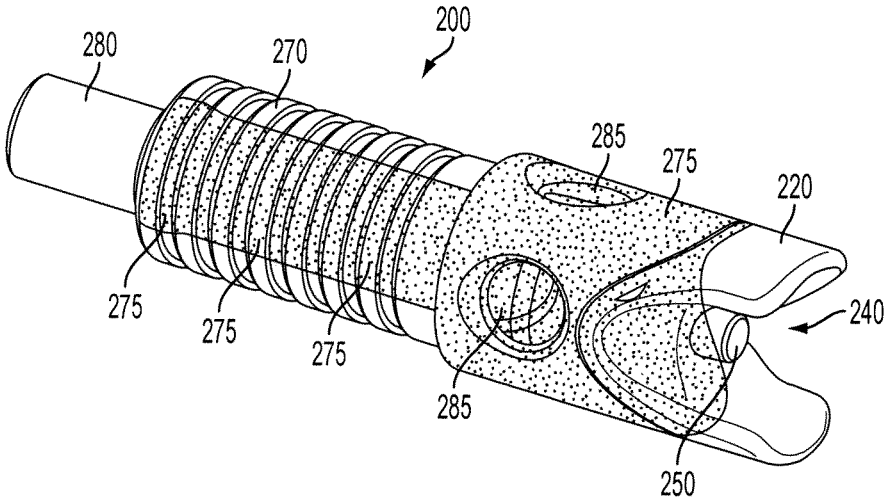
FIG. 2B depicts FIG. 2A with a darkened structural support piece.

FIGS. 2A and 2B depict a crossbow "capture" style nock 200 in accordance with an embodiment of the invention. Nock 200 has components similar to those of the nock 100 shown in FIG. 1, except that nock 200 includes structural support piece 275 that is attached to distal end 220, which contains a groove that provides opening 240. That groove and opening 240 are configured to receive the string of a crossbow.

Structural support piece 275 has a cylinder-like shape and substantially surrounds and structurally supports distal end 220 of nock 200. The distal end of structural support piece 275 contains a groove so that structural support piece 275 does not obstruct opening 240. In this embodiment, the distal end of structural support piece 275 contains four holes 285 (only two of which are visible in FIGS. 2A and 2B). All four holes allow for light to escape sideways from the nock. Other embodiments with different numbers of holes or semi-solid structures to allow light to escape from the sides of the nock in the desired amount can also be used. In the current embodiment, one of the holes permits access for turning off the light source within nock 200, another permits light to escape sideways from nock 200, and the other two are configured to allow structural support piece 275 to snap fit onto distal end 220 of nock 200. Distal end 220 in one aspect of this embodiment, contains protrusions configured to permit such a snap fit.

The distal end of structural support piece 275, which is cylindrically shaped, has a cross-sectional radius that is greater than that of the proximal end of structural support piece 275, as depicted in FIGS. 2A and 2B. The proximal end of structural support piece 275 is shaped and dimensioned so that it can receive the distal end of battery 280, which provides a power source for the light source (not depicted in FIGS. 2A and 2B) of nock 200. Intermediate portion 270 of nock 200 is configured to receive the proximal end of structural support piece 275 and has a grooved surface which is configured to compression fit into the bore of a crossbow bolt, such as bore 95 of crossbow bolt 90 of FIG. 1.

Nock 200 has components similar to those of the nock 100 shown in FIG. 1, except that nock 200 includes structural support piece 275 that is attached to distal end 220 that provides structural support for distal end 220, which is made from a clear polymeric material or polycarbonate to allow the transmission of light from the light source of nock 200 to the outside. In certain embodiments, distal end 220 can be made from a clear ceramic structural support material such as aluminum oxynitride (AlON), which has a Young's modulus of approximately 334 GPa and a shear modulus of approximately 135 GPa, which is substantially greater than the respective values associated with the clear polymeric material in the distal end 220 of nock 200. In certain embodiments, distal end 220 can also be made from nanoparticle aluminum oxide ($Al_2O_3$) or nanoparticle spinel ($MgAl_2O_4$).

In certain embodiments, structural support piece 275 is made from an aluminum alloy, which in this embodiment has a yield strength of 75,000 psi, which is much greater than the yield strength of the clear polymeric material in the distal end 220 of nock 200 that has an approximate yield strength of 9000 psi. Structural support piece 275 can also be made from a clear ceramic material such as AlON, nanoparticle aluminum oxide (Al2O3), or nanoparticle spinel (MgAl2O4). When the structural support piece 275 and the distal end 220 are made of, for example, AlON, nanoparticle aluminum oxide (Al2O3), or nanoparticle spinel (MgAl2O4), the structural support piece 275 and the distal end 220 can either be separate pieces, or manufactured as a single, integrated piece. It is generally preferable that the weight of the structural reinforcing piece and the entire assembly be as lightweight as possible. This is desirable, for example, to maintain good weight forward of center for flight stability. Each of the aforementioned aluminum alloy, AlON, nanoparticle aluminum oxide (Al2O3), and nanoparticle spinel (MgAl2O4) allow and can be utilized to accomplish such design objectives.

Structural support piece 275 may be constructed of or include other structural support materials such as Mg, Ti, steel, stainless steel, and/or high strength, structural polymeric or composite materials. Typically, such structural support materials (including aluminum) are not transparent or translucent to light emissions from the light source of nock 200 (which may be an LED), which distinguishes them from, for example, conventional clear polymeric materials, a clear ceramic material such as AlON, nanoparticle aluminum oxide (Al2O3), or nanoparticle spinel (MgAl2O4), that can be used in constructing distal end 220 of nock 200. Structural polymer materials that may be used to construct structural support piece 275 may include: nylon, delrin, carbon reinforced polymers, fiberglass reinforced polymers, PEEK, PMMA, and/or urethane. Additional polymers or composites serving the same purpose of supporting the less structurally robust clear polymeric piece in a lighted nock may be used in embodiments of the invention. As noted above, structural support piece 275 may also be made from, for example, a clear ceramic such as AlON, nanoparticle aluminum oxide (Al2O3), or nanoparticle spinel (MgAl2O4).

Figure 3A:
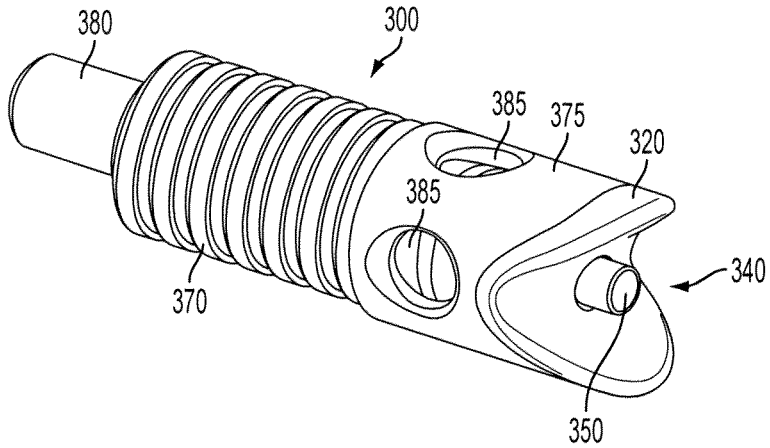
FIG. 3A depicts a crossbow half-moon nock in accordance with an embodiment of the invention.
Figure 3B:
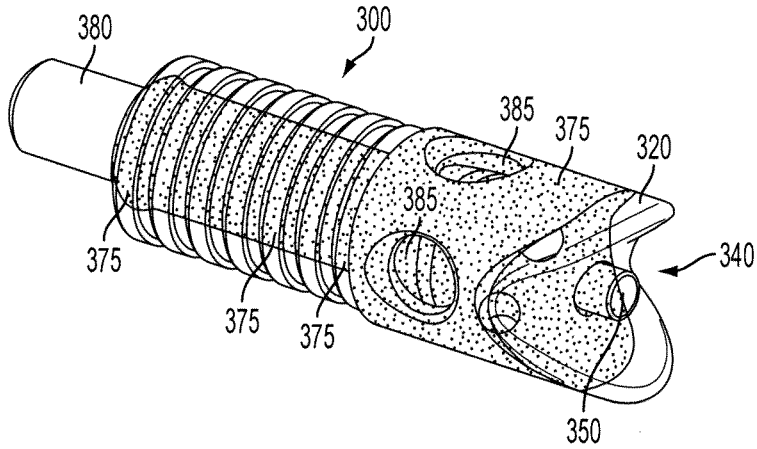
FIG. 3B depicts FIG. 3A with a darkened structural support piece.

FIGS. 3A and 3B depict a crossbow half-moon nock 300 in accordance with an embodiment of the invention. Nock 300 has components similar to those of "capture" style nock 200 of FIGS. 2A and 2B. In particular, nock 300 includes structural support piece 375 that is attached to distal end 320, which contains a groove that provides opening 340. That groove and opening 340 are configured to receive the string of a crossbow. Structural support piece 375 has a cylinder-like shape and substantially surrounds and structurally supports distal end 320 of nock 300. The distal end of structural support piece 375 contains a groove so that structural support piece 375 does not obstruct opening 340. In this embodiment, the distal end of structural support piece 375 contains four holes 385 (only two of which are visible in FIGS. 3A and 3B). All four holes allow for light to escape sideways from the nock. Other embodiments with different numbers of holes or semi-solid structures to allow light to escape from the sides of the nock in the desired amount can also be utilized. In the current embodiment, one of the holes permits access for turning off the light source within nock 300, another permits light to escape sideways from nock 300, and the other two are configured to allow structural support piece 375 to snap fit onto distal end 320 of nock 300. Distal end 320 in one aspect of this embodiment, contains protrusions configured to permit such a snap fit.

The distal end of structural support piece 375, which is cylindrically shaped, has a cross-sectional radius that is greater than that of the proximal end of structural support piece 375, as depicted in FIGS. 3A and 3B. The proximal end of structural support piece 375 is shaped and dimensioned so that it can receive the distal end of battery 380, which provides a power source for the light source (not depicted in FIGS. 3A and 3B) of nock 300. Intermediate portion 370 of nock 300 is configured to receive the proximal end of structural support piece 375 and has a grooved surface which is configured to compression fit into the bore of a crossbow bolt, such as bore 95 of crossbow bolt 90 of FIG. 1.

Nock 300 includes structural support piece 375 that provides structural support for distal end 320, which is made from a clear polymeric material or polycarbonate to allow the transmission of light from the light source of nock 300 to the outside. In certain embodiments, structural support piece 375 is made from an aluminum alloy, which in this embodiment has a yield strength of 75,000 psi, which is much greater than the yield strength of the clear polymeric material in the distal end 320 of nock 200 that has an approximate yield strength of 9000 psi. Structural support piece 375 can also be made from, for example, AlON, nanoparticle aluminum oxide (Al2O3), or nanoparticle spinel (MgAl2O4).

Structural support piece 375 may be constructed of or include other structural support materials such as Mg, Ti, steel, stainless steel, or high strength, structural polymeric or composite materials. Typically, such structural support materials (including aluminum) are not transparent or translucent to light emissions from the light source of nock 300 (which may be an LED), which distinguishes them from, for example, the clear polymeric materials, AlON, nanoparticle aluminum oxide (Al2O3), or nanoparticle spinel (MgAl2O4), that can be used to construct distal end 320 of nock 300. Structural polymer materials that may be used to construct structural support piece 375 may include: nylon, delrin, carbon reinforced polymers, fiberglass reinforced polymers, PEEK, PMMA, and urethane. Additional polymers or composites serving the same purpose of supporting the less structurally robust clear polymeric piece in a lighted nock may be used in embodiments of the invention.

Figure 4A:
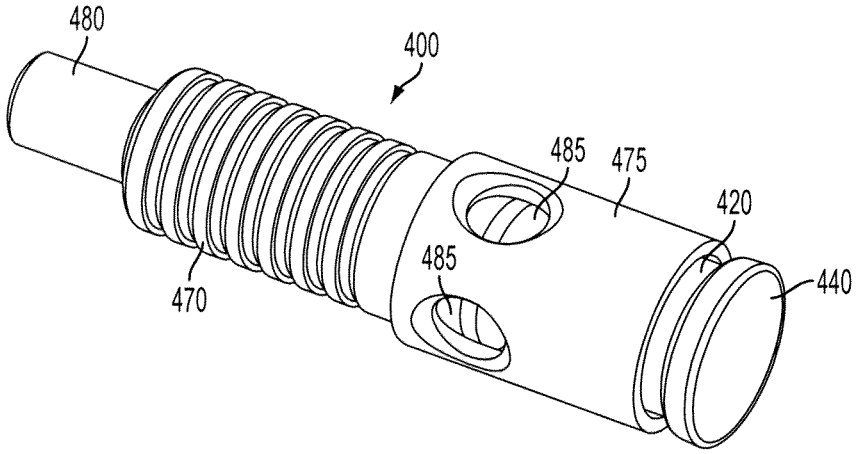
FIG. 4A depicts a crossbow flat back nock in accordance with an embodiment of the invention.
Figure 4B:
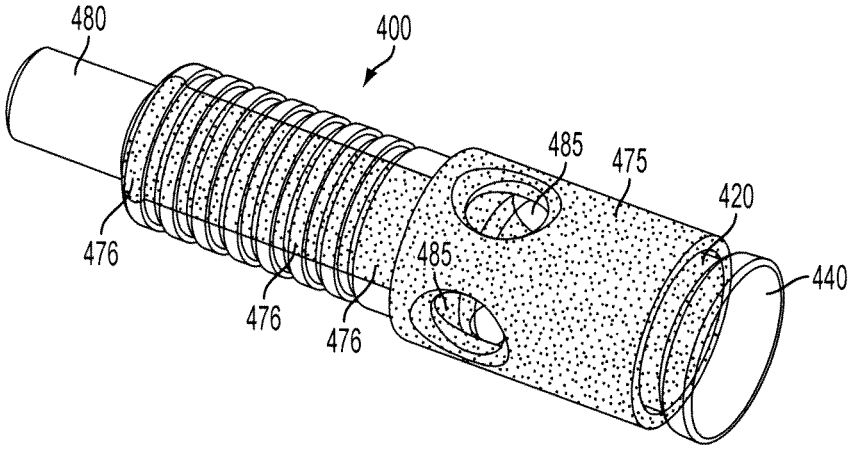
FIG. 4B depicts FIG. 3A with a darkened structural support piece.

FIGS. 4A and 4B depict a crossbow flat back nock 400 in accordance with an embodiment of the invention. Nock 400 has components similar to those of "capture" style nock 200 of FIGS. 2A and 2B. In particular, nock 400 includes structural support piece 475 that is attached to distal end 420. Nock 400, however, has a flat back (instead of a groove and opening at its distal end) that is configured to couple to the string of a crossbow during operation.

Structural support piece 475 has a cylinder-like shape and substantially surrounds and structurally supports distal end 420 of nock 400. Because of the absence of a groove and opening on distal end 420 of nock 400, structural support piece 475 need not have a matching groove, unlike the embodiments discussed in connection with FIGS. 2A, 2B, 3A and 3B. For this reason, in this embodiment, the distal end 420 of structural support piece 475 is approximately cylindrically shaped.

Furthermore, in this embodiment, the distal end of structural support piece 475 contains four holes 485 (only two of which are visible in FIGS. 4A and 4B). All four holes allow for light to escape sideways from the nock 400. Other embodiments with different numbers of holes or semi-solid structures can also be used to allow light to escape from the sides of the nock in the desired amount. In the current embodiment, one of the holes permits access for turning off the light source within nock 400, another permits light to escape sideways from nock 400, and the other two are configured to allow structural support piece 475 to snap fit onto distal end 420 of nock 400. Distal end 420 in one aspect of this embodiment, contains protrusions configured to permit such a snap fit.

The distal end 420 of structural support piece 475, which is cylindrically shaped, has a cross-sectional radius that is greater than that of the proximal end of structural support piece 475, as depicted in FIG. 4B. The proximal end of structural support piece 475 is shaped and dimensioned so that it can receive the distal end of battery 480, which provides a power source for the light source (not depicted in FIGS. 4A and 4B) of nock 400. Intermediate portion 470 of nock 400 is configured to receive the proximal end of structural support piece 475 and has a grooved surface 476 which is configured to compression fit into the bore of a crossbow bolt, such as bore 95 of crossbow bolt 90 of FIG. 1.

Structural support piece 475 provides structural support for distal end 420, which is made from a clear polymeric or polycarbonate material to allow the transmission of light from the light source of nock 400 to the outside. Distal end 420 can also be made from, for example, a clear ceramic such as AlON, nanoparticle aluminum oxide (Al2O3), or nanoparticle spinel (MgAl2O4). In certain embodiments, structural support piece 475 is made from an aluminum alloy, which in this embodiment has a yield strength of 75,000 psi, which is much greater than the yield strength of the clear polymeric material in the distal end 420 of nock 400 that has an approximate yield strength of 9000 psi. Structural support piece 475 can also be made from, for example, a clear ceramic such as AlON, nanoparticle aluminum oxide (Al2O3), or nanoparticle spinel (MgAl2O4).

Structural support piece 475 may also be constructed of or include other structural support materials such as Mg, Ti, steel, stainless steel, or high strength, structural polymeric or composite materials. Typically, such structural support materials (including aluminum) are not transparent or translucent to light emissions from the light source of nock 400 (which may be an LED), which distinguishes them from, for example, conventional polymeric materials, clear ceramic such as AlON, nanoparticle aluminum oxide (Al2O3), or nanoparticle spinel (MgAl2O4) that may be used to construct the distal end 420 of nock 400. Structural polymer materials that may be used to construct structural support piece 475 may include: nylon, delrin, carbon reinforced polymers, fiberglass reinforced polymers, PEEK (polyether ether ketone), PMMA (polymethyl methacrylate), and urethane. Additional polymers or composites serving the same purpose of supporting the less structurally robust clear polymeric piece in a lighted nock may be used in embodiments of the invention.

Besides the increased structural integrity that embodiments of this invention offer in comparison to polymeric nocks lacking a structural support piece, they also offer lighting performance advantages. In conventional lighted nocks that only or substantially only include a clear polycarbonate body, the enclosed light within the assembly is free to disburse in all directions in a semi-diffuse pattern. By encasing the light and polycarbonate subassembly within an anodized aluminum assembly (which may also serve as a structural support piece), a focusing effect may be obtained that significantly increases the visual light intensity of the lighted nock when viewed from behind the projectile, as an archer would do after releasing the arrow or bolt. This effect is similar to what can be observed in a flashlight that contains a reflector piece in proximity to the light bulb, which results in a greater intensity of the projected light compared to a situation in which the reflector is absent.

In embodiments of the current invention in which anodized aluminum is used as the structural support piece, this effect is caused by the natural reflectivity of anodized aluminum which is approximately 80%. As a result, the light intensity when viewed from the archer's perspective can be more than double the intensity compared to the intensity that can be obtained based on conventional lighted nocks. It is well known that the reflectivity of materials, including structural support materials, varies from material to material. Accordingly, embodiments of the present invention enable the reflectivity in the backwards direction to be adjusted or optimized by choosing a structural support material that has a desired reflectivity property, and shaping the structural support material for providing reflection in that backwards direction.

Figure 5A:
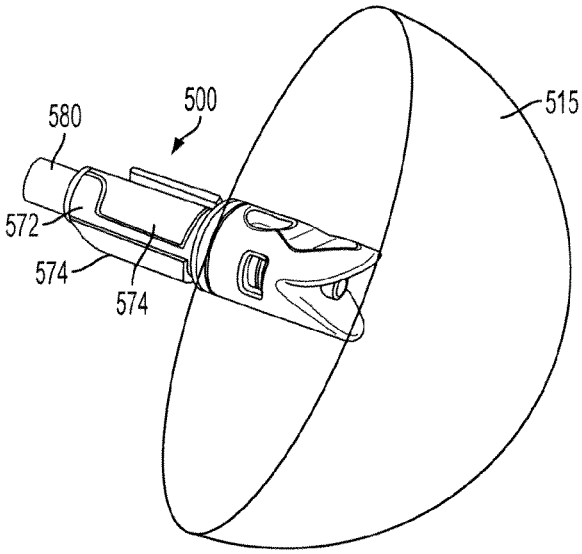
FIGS. 5A and 5B depict the lighting advantage that may be obtained in certain embodiments of the invention.
Figure 5B:
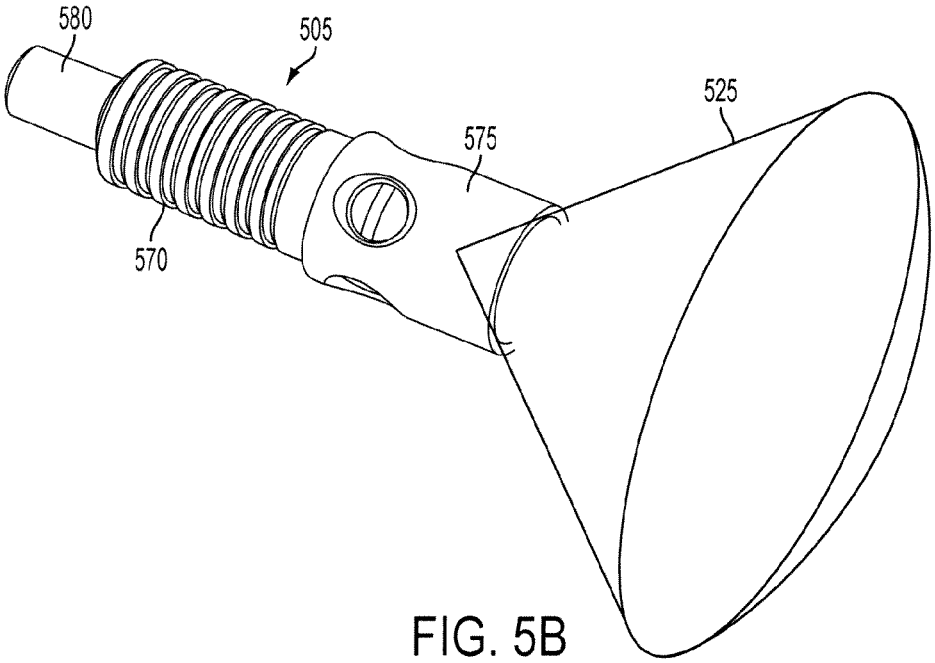

FIGS. 5A and 5B depict the lighting advantage that may be obtained in certain embodiments of the invention. FIG. 5A depicts the approximate solid angle 515 through which most of the light emanating from a conventional nock 500 is transmitted. In conventional lighted nocks, there is no optically dense structural support piece that covers or partially covers the distal end of the nock (which, as discussed earlier, is ordinarily made from an optically clear polymeric or polycarbonate material). Accordingly, the solid angle through which most of the optical intensity is transmitted is large, and, for example, may be approximately hemispherical in shape as depicted in FIG. 5A.

However, where the nock (such as nock 505 of FIG. 5B) includes a structural support piece 575 that is made of one or more substances that reflect light (e.g., such as a metal), the structural support piece 575 may reflect light such that most of the light emanating from nock 505 is directed through a solid angle (such as cone 525 of FIG. 5B) that is smaller than that obtained when no such structural support piece 575 is present. Thus, in certain embodiments, a reflective structural support piece 575 may focus the light emanating from nock 505 in the backward direction (i.e., the direction backwards from the direction of propagation of the bolt), making the bolt more optically visible to the user after it has been shot from the bow or crossbow.

Figure 6B:
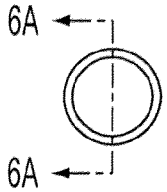
FIG. 6B is an end view of FIG. 6A, showing cross-section lines 6A-6A.
Figure 6A:
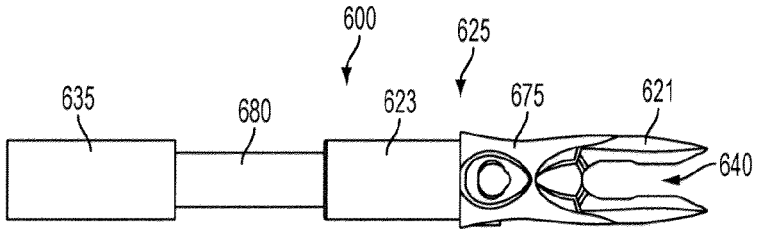
FIG. 6A depicts another nock embodiment utilizing a structural support piece.
Figure 6C:
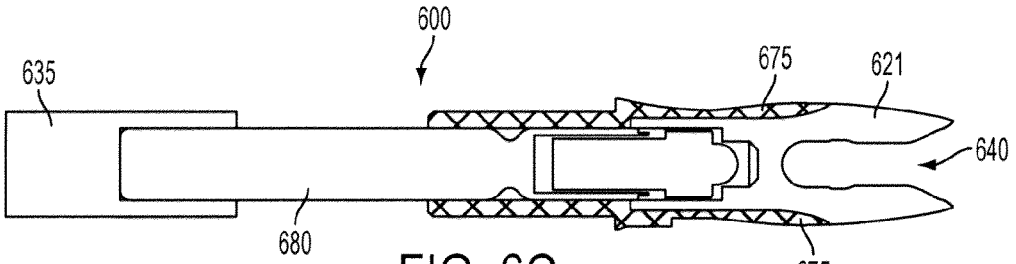
FIG. 6C shows the cross sectional view of section 6A-6A of FIG. 6A when the nock light is off.
Figure 6D:
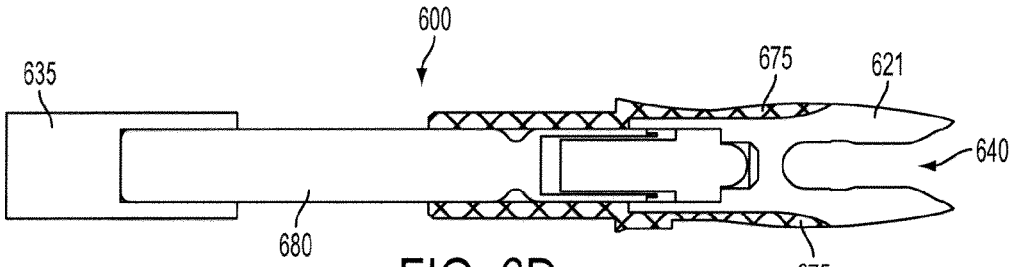
Figure 6E:
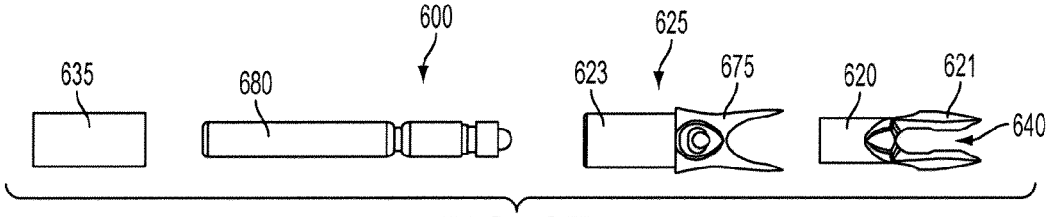
FIG. 6E shows an exploded view of the nock shown in FIG. 6A.

Embodiments of the present invention may be used with a variety of nock designs. For example, FIGS. 6A-6E depict a modification of a nock of U.S. Pat. No. 7,021,784, which is hereby incorporated by reference in its entirety, in which a structural support piece 625 in accordance with the present invention provides structural support for distal end 620 of nock 600, similar to that of the discussion in connection with the earlier embodiments. More particularly, FIG. 6A depicts nock 600 embodiment utilizing a structural support piece 625. FIG. 6B is an end view of FIG. 6A, showing cross-section lines 6A-6A. FIG. 6C shows the cross sectional view of section 6A-6A of FIG. 6A when the nock light is off. FIG. 6D shows the cross sectional view of section 6A-6A of FIG. 6A when the nock light is on. FIG. 6E shows an exploded view of the nock shown in FIG. 6A.

In FIGS. 6A-6E, proximal end 623 and distal end 675 of structural support piece 625 may be both made of structural support materials as discussed earlier. Alternatively, only one of proximal end 623 and distal end 675 (e.g., proximal end 623) of structural support piece 625 may be made of structural support materials. Further, distal end 620 of nock 600 may also at least in part be made from a structural support material. For example, the end portion 621 of distal end 620 (which includes a groove providing opening 640) may be made from such a structural support material.

Nock 600 may have components generally similar to those of the nocks discussed in earlier embodiments. For example, distal end 620 may at least in part be made from, for example, a clear polymeric or polycarbonate material, AlON, nanoparticle aluminum oxide (Al2O3), or nanoparticle spinel (MgAl2O4), to allow light to escape from the back of nock 600. The embodiment depicted in FIGS. 6A-6E additionally includes a conventional end cap 635.

Figure 7B:
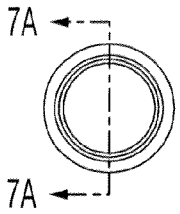
FIG. 7B is an end view of FIG. 7A, showing cross-section lines 7A-7A.
Figure 7A:
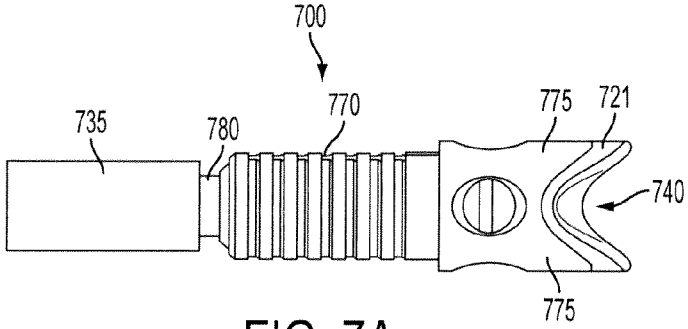
FIG. 7A depicts another nock embodiment utilizing a structural support piece.
Figure 7C:
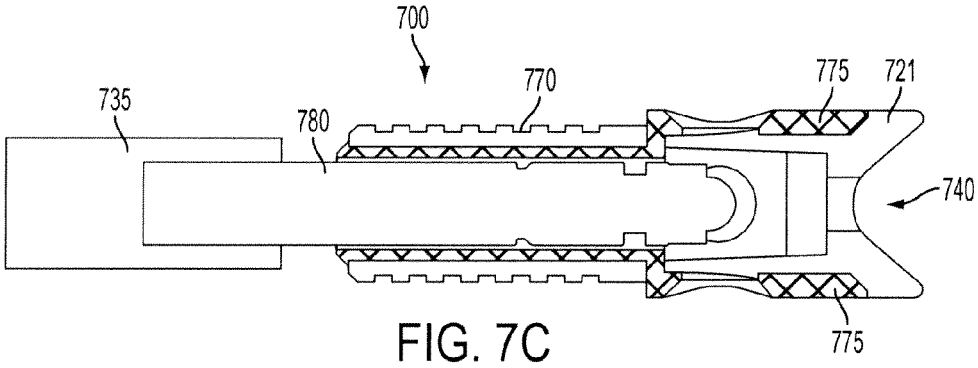
FIG. 7C shows the cross sectional view of section 7A-7A of FIG. 7A when the nock light is off.
Figure 7D:
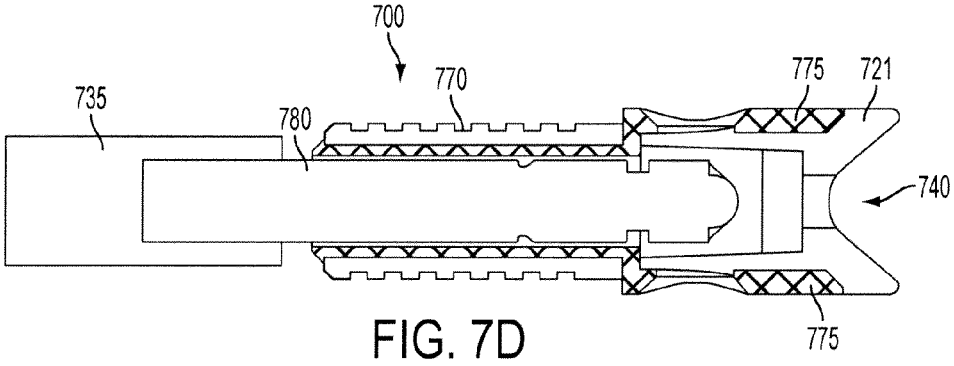
Figure 7E:
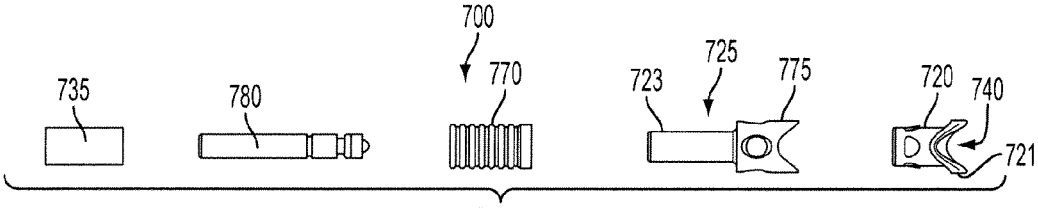
FIG. 7E shows an exploded view of the nock shown in FIG. 7A.

FIGS. 7A-7D depicts an a bolt nock of U.S. Pat. No. 7,021,784 in which a structural support piece 725 in accordance with the present invention provides structural support for distal end 720 of nock 700, similar to that of the discussion in connection with the earlier embodiments. More particularly, FIG. 7A depicts a profile view of nock 700. FIG. 7B is an end view of FIG. 7A, showing cross-section lines 7A-7A. FIG. 7C shows the cross sectional view of section 7A-7A of FIG. 7A when the nock light is off. FIG. 7D shows the cross sectional view of section 7A-7A of FIG. 7A when the nock light is on. FIG. 7E shows an exploded view of the nock shown in FIG. 7A.

In this embodiment, proximal end 723 and distal end 775 of structural support piece 725 may be both made of structural support materials as discussed earlier. Alternatively, only one of proximal end 723 and distal end 775 (e.g., distal end 775) of structural support piece 725, may be made of structural support materials. Further, distal end 720 of nock 700 may also at least in part be made from a structural support material. For example, the end portion 721 of distal end 720 (which includes a groove providing opening 740) may be made from such a structural support material.

Nock 700 may have components generally similar to those of the nocks discussed in earlier embodiments. For example, distal end 720 may at least in part be made from, for example, a clear polymeric or polycarbonate material, AlON, nanoparticle aluminum oxide (Al2O3), or nanoparticle spinel (MgAl2O4), to allow light to escape from the back of nock 700. The embodiment depicted in FIGS. 7A-7D additionally includes a conventional end cap 735. This embodiment also includes intermediate portion 770 of nock 700, which is configured to receive proximal end 723 of structural support piece 725 and which has a ribbed or grooved surface which is configured to provide a compression fit with varying sizes of a crossbow bolt, such as bore 95 of crossbow bolt 90 of FIG. 1, and the rest of nock 700.

Figure 8B:
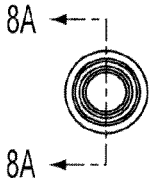
FIG. 8B is an end view of FIG. 8A, showing cross section lines 8A-8A.
Figure 8A:
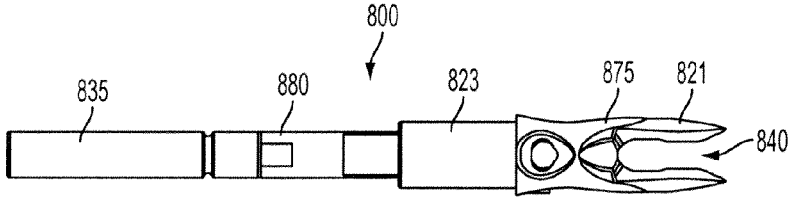
FIG. 8A depicts another nock embodiment utilizing a structural support piece.
Figure 8C:
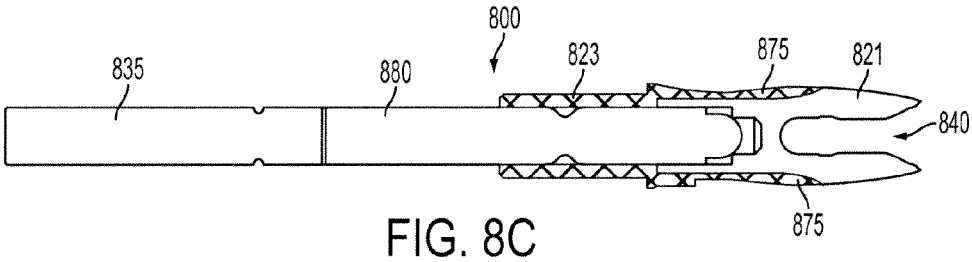
FIG. 8C shows the cross sectional view of section 8A-8A of FIG. 8A.
Figure 8D:
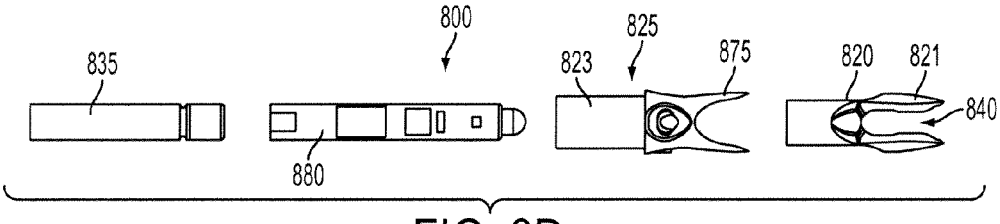
FIG. 8D shows an exploded view of FIG. 8A.

FIGS. 8A-8D depict a modification of an arrow nock of U.S. Pat. No. 7,993,224, which is hereby incorporated by reference in its entirety. More particularly, FIG. 8A depicts a profile view of nock 800. FIG. 8B is an end view of FIG. 8A, showing cross section lines 8A-8A. FIG. 8C shows the cross sectional view of section 8A-8A of FIG. 8A. FIG. 8D shows an exploded view of FIG. 8A.

Nock 800 can include an accelerometer-activated system with a replaceable battery and a microprocessor. In another embodiment of nock 800, the accelerometer-activated system could include a non-replaceable battery.

The nock 800 of FIGS. 8A-8D includes a structural support piece 825 that provides structural support for distal end 820 of nock 800, similar to that of the discussion in connection with the earlier embodiments. In this embodiment, proximal end 823 and distal end 875 of structural support piece 825 may be both made of structural support materials as discussed earlier. Alternatively, only one of proximal end 823 and distal end 875 (e.g., distal end 875) of structural support piece 825, may be made of structural support materials. Further, distal end 820 of nock 800 may also at least in part be made from a structural support material. For example, the end portion 821 of distal end 820 (which includes a groove providing opening 840) may be made from such a structural support material.

Nock 800 may have components generally similar to those of the nocks discussed in earlier embodiments. For example, distal end 820 may at least in part be made from, for example, a clear polymeric or polycarbonate material, a clear ceramic material such as AlON, nanoparticle aluminum oxide (Al2O3), or nanoparticle spinel (MgAl2O4), to allow light to escape from the back of nock 800. The embodiment depicted in FIGS. 8A-8C additionally includes battery 835 and light source-holding piece 880, which may also include an accelerometer.

Figure 9B:
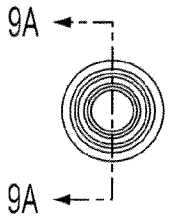
FIG. 9B is an end view of FIG. 9A, showing cross section lines 9A-9A.
Figure 9A:
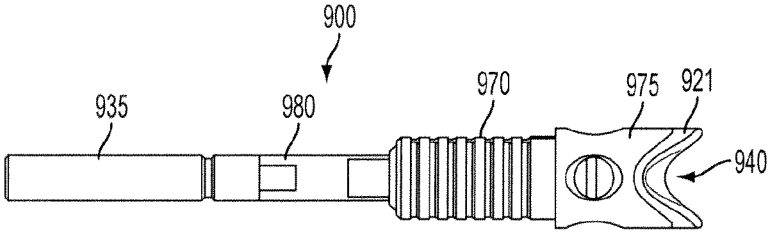
FIG. 9A depicts another nock embodiment utilizing a structural support piece.
Figure 9C:
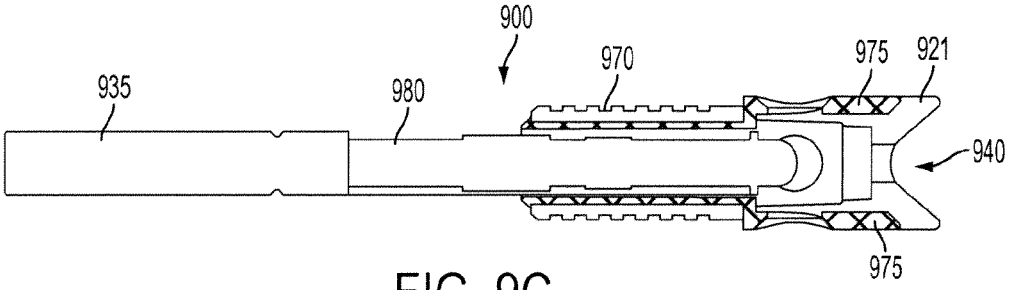
FIG. 9C shows the cross sectional view of section 9A-9A of FIG. 9A.
Figure 9D:
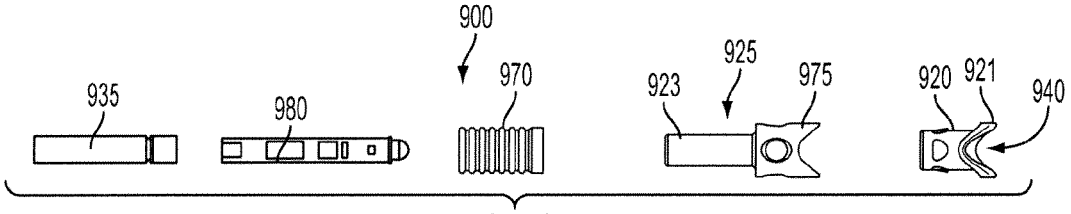
FIG. 9D shows an exploded view of FIG. 9A.

FIGS. 9A-9D depict a modification of a bolt nock of U.S. Pat. No. 7,993,224. More particularly, FIG. 9A depicts a profile view of nock 900. FIG. 9B is an end view of FIG. 9A, showing cross section lines 9A-9A. FIG. 9C shows the cross sectional view of section 9A-9A of FIG. 9A. FIG. 9D shows an exploded view of FIG. 9A.

Nock 900 can also include an accelerometer-activated system with a replaceable battery and a microprocessor. In another embodiment of nock 900, the accelerometer-activated system could include a non-replaceable battery Nock 900 as shown in of FIGS. 9A-9D includes a structural support piece 925 that provides structural support for distal end 920 of nock 900, similar to that of the discussion in connection with the earlier embodiments. In this embodiment, proximal end 923 and distal end 975 of structural support piece 925 may be both made of structural support materials as discussed earlier. Alternatively, only one of proximal end 923 and distal end 975 (e.g., distal end 975) of structural support piece 925, may be made of structural support materials. Further, distal end 920 of nock 900 may also at least in part be made from a structural support material. For example, the end portion 921 of distal end 920 (which includes a groove providing opening 940) may be made from such a structural support material.

Nock 900 may have components generally similar to those of the nocks discussed in earlier embodiments. Distal end 920 may at least in part be made from, for example, a clear polymeric or polycarbonate material, a clear ceramic such as AlON, nanoparticle aluminum oxide (Al2O3), or nanoparticle spinel (MgAl2O4), to allow light to escape from the back of nock 900. The embodiment depicted in FIGS. 9A-9D additionally includes intermediate portion 970 of nock 900, which is configured to receive proximal end 923 of structural support piece 925 and which has a ribbed or grooved surface which is configured to provide a compression fit with varying sizes of a crossbow bolt, such as bore 95 of crossbow bolt 90 of FIG. 1, and the rest of nock 700. The embodiment depicted in FIGS. 9A-9D additionally includes battery 935 and light source-holding piece 980, which may also include an accelerometer.

Figure 10B:
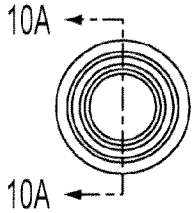
FIG. 10B is an end view of FIG. 10A, showing cross section lines 10A-10A.
Figure 10A:
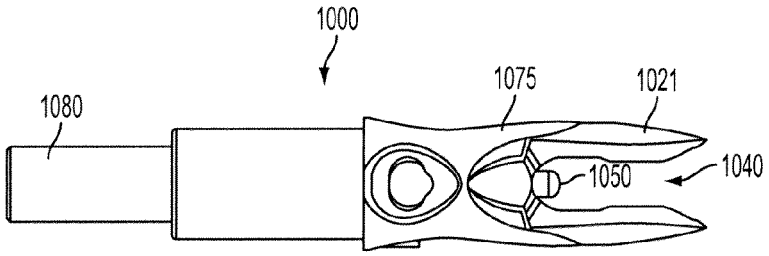
FIG. 10A depicts another nock embodiment utilizing a structural support piece.
Figure 10C:
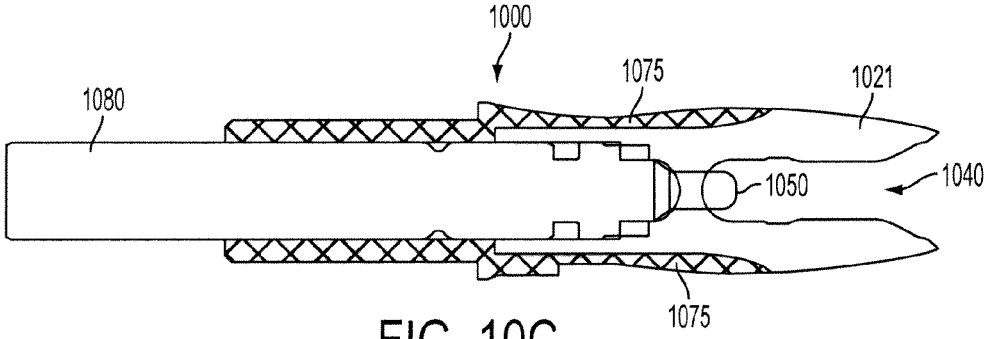
FIG. 10C shows the cross sectional view of section 10A-10A of FIG. 10A.
Figure 10D:
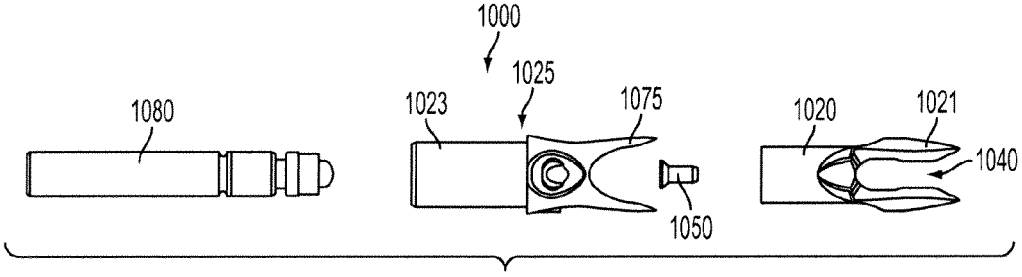
FIG. 10D shows an exploded view of FIG. 10A.

FIGS. 10A-10D depicts nock 1000, which includes a structural support piece 1025 that provides structural support for distal end 1020 of nock 1000, similar to that of the discussion in connection with the earlier embodiments. More particularly, FIG. 10A depicts a profile view of nock 1000. FIG. 10B is an end view of FIG. 10A, showing cross section lines 10A-10A. FIG. 10C shows the cross sectional view of section 10A-10A of FIG. 10A. FIG. 10D shows an exploded view of FIG. 10A.

In this embodiment, proximal end 1023 and distal end 1075 of structural support piece 1025 may be both made of structural support materials as discussed earlier. Alternatively, only one of proximal end 1023 and distal end 1075 (e.g., distal end 1075) of structural support piece 1025, may be made of structural support materials. Further, distal end 1020 of nock 1000 may also at least in part be made from a structural support material. For example, the end portion 1021 of distal end 1020 (which includes a groove providing opening 1040) may be made from such a structural support material.

Nock 1000 may have components generally similar to those of the nocks discussed in earlier embodiments. Distal end 1020 may at least in part be made from, for example, a clear polymeric or polycarbonate material, a clear ceramic such as AlON, nanoparticle aluminum oxide (Al2O3), or nanoparticle spinel (MgAl2O4), to allow light to escape from the back of nock 1000. The embodiment depicted in FIGS. 10A-10D additionally includes battery 1080 and button 1050, which may also be made from a clear polymeric or polycarbonate material, a clear ceramic such as AlON, nanoparticle aluminum oxide (Al2O3), or nanoparticle spinel (MgAl2O4), to allow light to escape from the back of nock 1000. Button 1050 is configured to turn on the light source of nock 1000 when depressed (for example, when depressed due to the tension of the bow string during operation).

Figure 11B:
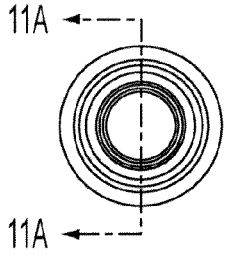
FIG. 11B is an end view of FIG. 11A, showing cross section lines 11A-11A.
Figure 11A:
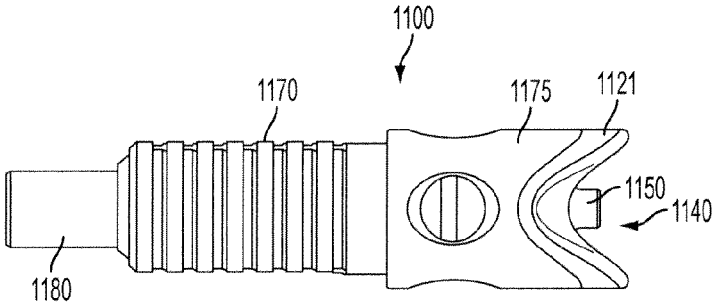
FIG. 11A depicts another nock embodiment utilizing a structural support piece.
Figure 11C:
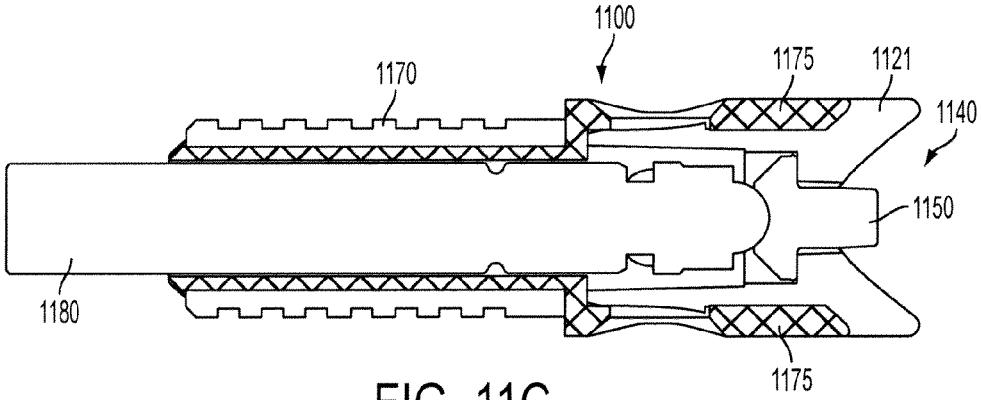
FIG. 11C shows the cross sectional view of section 11A-11A of FIG. 11A.
Figure 11D:
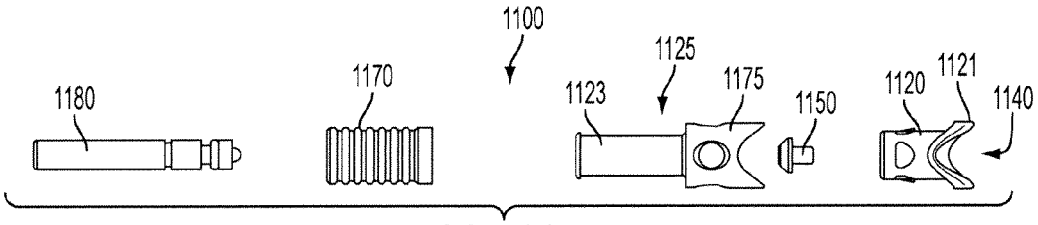
FIG. 11D shows an exploded view of FIG. 11A.

FIGS. 11A-11D depict nock 1100, which includes a structural support piece 1125 that provides structural support for distal end 1120 of nock 1100, similar to that of the discussion in connection with the earlier embodiments. More particularly, FIG. 11A depicts a profile view of nock 1100. FIG. 11B is an end view of FIG. 11A, showing cross section lines 11A-11A. FIG. 11C shows the cross sectional view of section 11A-11A of FIG. 11A. FIG. 11D shows an exploded view of FIG. 11A.

In this embodiment, proximal end 1123 and distal end 1120 of structural support piece 1125 may be both made of structural support materials as discussed earlier. Alternatively, only one of proximal end 1123 and distal end 1120 (e.g., distal end 1120) of structural support piece 1125, may be made of structural support materials. Further, distal end 1120 of nock 1100 may also at least in part be made from a structural support material. For example, the end portion 1121 of distal end 1120 (which includes a groove providing opening 1140) may be made from such a structural support material.

Nock 1100 may have components generally similar to those of the nocks discussed in earlier embodiments. For example, distal end 1120 may at least in part be made from a clear polymeric or polycarbonate material, AlON, nanoparticle aluminum oxide (Al2O3), or nanoparticle spinel (MgAl2O4), to allow light to escape from the back of nock 1100. The embodiment depicted in FIGS. 11A-11D additionally includes battery 1180, intermediate portion 1170 (which is configured to receive proximal end 1123 of structural support piece 1125 and which has a ribbed or grooved surface which is configured to provide a compression fit with varying sizes of a crossbow bolt, such as bore 95 of crossbow bolt 90 of FIG. 1, and the rest of nock 1100) and button 1150, which may also be made from, for example, a clear polymeric or polycarbonate material, a clear ceramic such as AlON, nanoparticle aluminum oxide (Al2O3), or nanoparticle spinel (MgAl2O4), to allow light to escape from the back of nock 1100. Button 1150 is configured to turn on the light source of nock 1100 when depressed (for example, when depressed due to the tension of the crossbow string during operation).

As discussed above, in certain embodiments of the current invention, the preferably aluminum body of the nock includes a clear polycarbonate insert piece or clear insert piece made from, for example, a clear ceramic such as AlON, nanoparticle aluminum oxide (Al2O3), or nanoparticle spinel (MgAl2O4), that permits light transmission through that insert piece. The aluminum body of the nock may also provide structural support to the insert piece that is used with arrows and crossbow bolts.

Metallic structural support pieces used in embodiments of the current invention may be manufactured using machining, similar to the techniques used in manufacturing metallic fittings and components used in ordinary consumer products. For example, a turning center, CNC (computer numerical controlled) lather, CNC mill, screw machine, or a combination thereof may be used for this purpose. Structural support pieces made from structural polymeric materials or composite polymeric materials, a clear ceramic such as AlON, nanoparticle aluminum oxide (Al2O3), or nanoparticle spinel (MgAl2O4), may typically be manufactured through using injection molding, but could also be manufactured using machining techniques. The clear polycarbonate or other light transmitting material would typically be manufactured via injection molding.

The structural support piece may be attached to the insert piece made from a polymer, a clear ceramic such as AlON, nanoparticle aluminum oxide (Al2O3), or nanoparticle spinel (MgAl2O4) through the use of a snap or compression fit, through the use of matching male-female threads on these components and/or through the use of adhesives. For example, to implement a snap of compression fit between components of the invention that are envisioned to attach to one another, grooves and corresponding protrusions may be formed on the surfaces of such components. More generally, other conventional ways of assembling components of the lighted nocks of the current invention can also be utilized.

Embodiments of the present invention have been described for the purpose of illustration and are not limiting, and may be practiced with modifications and alterations limited only by the spirit and scope of the appended claims which are intended to cover such modifications and alterations, so as to afford broad protection to the various embodiments of invention and their equivalents.

Having thus described our invention, what we claim as new and desire to secure by Letters Patent is as follows:

1. A nock configured for attachment to a distal end of an arrow or a bolt, the nock comprising:

a slotted first end configured to receive the string of a bow, wherein the slotted first end is at least partially optically clear;

a power source;

a light source;

a second end configured to attach to the distal end of the arrow or the bolt; and a structural support piece coupled to the slotted first end and partially covering and supporting the slotted first end, wherein the structural support piece is optically clear.

2. The nock of claim 1, wherein the structural support piece comprises a ceramic.

3. The nock of claim 2, wherein the ceramic comprises AlON (aluminum oxynitride).

4. A nock configured for attachment to a distal end of an arrow or a bolt, the nock comprising:

a slotted first end configured to receive the string of a bow, wherein the slotted first end is at least partially optically clear;

a power source;

a light source;

a second end configured to attach to the distal end of the arrow or the bolt, wherein the second end comprises a grooved cylindrical surface configured to snap-fit or attach by compression to the distal end of the arrow or the bolt; and a structural support piece coupled to the slotted first end and partially covering and supporting the slotted first end, wherein the structural support piece comprises a metal, a graphite material, or a structural polymeric or composite material, and wherein the structural support piece is optically not clear.

5. A nock configured for attachment to a distal end of an arrow or a bolt, the nock comprising:

a slotted first end configured to receive the string of a bow, wherein the slotted first end is at least partially optically clear;

a power source;

a light source;

a second end configured to attach to the distal end of the arrow or the bolt, wherein the second end comprises compressible projecting protrusions configured to attach by compression to the distal end of the arrow or the bolt; and a structural support piece coupled to the slotted first end and partially covering and supporting the slotted first end, wherein the structural support piece comprises a metal, a graphite material, or a structural polymeric or composite material, and wherein the structural support piece is optically not clear.

6. A nock configured for attachment to a distal end of an arrow or a bolt, the nock comprising:

a slotted first end configured to receive the string of a bow, wherein the slotted first end is at least partially optically clear;

a power source;

a light source;

a second end configured to attach to the distal end of the arrow or the bolt; and a structural support piece coupled to the slotted first end and partially covering and supporting the slotted first end, wherein the structural support piece comprises a metal, a graphite material, or a structural polymeric or composite material, wherein the structural support piece is optically not clear, and wherein the structural support piece is made from a optically reflective material.

7. The nock of claim 6, wherein the structural support piece is made from a reflective metal.

8. The nock of claim 7, wherein the structural support piece is made from a reflective metal alloy.

9. The nock of claim 6, wherein light from the nock is more focused in the backwards directions compared to the nock without the structural support piece.

* * * * *